US007694616B2

(12) United States Patent
Schmauder

(10) Patent No.: US 7,694,616 B2
(45) Date of Patent: Apr. 13, 2010

(54) SPINDLE DRIVE SUPPORT

(75) Inventor: Frank Schmauder, Metzingen (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 166 days.

(21) Appl. No.: 11/563,613

(22) Filed: Nov. 27, 2006

(65) Prior Publication Data

US 2007/0107574 A1 May 17, 2007

Related U.S. Application Data

(63) Continuation of application No. PCT/EP2005/005635, filed on May 25, 2005.

(30) Foreign Application Priority Data

May 27, 2004 (EP) ..... 04012522

(51) Int. Cl.
*B26D 5/08* (2006.01)

(52) U.S. Cl. ..... 83/577; 83/631

(58) Field of Classification Search ..... 83/631, 83/577

See application file for complete search history.

(56) References Cited

U.S. PATENT DOCUMENTS 1,147,234 A * 7/1915 Gladwin ..... 83/631
1,484,114 A * 2/1924 Dee ..... 83/631
2,617,914 A * 11/1952 Keller et al. ..... 269/3
3,376,728 A * 4/1968 Nemessanyi ..... 83/631
4,587,737 A * 5/1986 Wilson ..... 83/631
4,881,399 A * 11/1989 Bocharov et al. ..... 83/631
5,090,284 A * 2/1992 Nakajima ..... 83/577
5,123,342 A * 6/1992 Camossi ..... 83/631
5,269,213 A * 12/1993 Coneski et al. ..... 83/577
5,279,197 A * 1/1994 Takeda et al. ..... 83/631
5,373,765 A * 12/1994 Asano et al. ..... 83/631
5,609,081 A * 3/1997 Lin ..... 83/631
5,669,296 A * 9/1997 Newton ..... 83/631

(Continued)

FOREIGN PATENT DOCUMENTS

JP 04-105793 4/1992

(Continued)

OTHER PUBLICATIONS

International Preliminary Report on Patentability for corresponding application serial No. PCT/EP2005/005635, issued Nov. 29, 2206.

*Primary Examiner*—Jason Daniel Prone
(74) *Attorney, Agent, or Firm*—Fish & Richardson P.C.

(57) ABSTRACT

There is provided a machine for processing workpieces. In one embodiment, there is provided a workpiece processing machine including a processing tool movable along a tool drive axis to engage a workpiece with a force, a spindle coupled to the processing tool and having two helical spindle drive threads spaced apart along the tool drive axis, through which drive threads tool forces are transmitted, and one or more drive motors operable to move the spindle by applying force through the spindle drive threads to displace the spindle and the tool along the tool drive axis, wherein the processing tool is coupled to the spindle to transmit force from the tool to the spindle by a force transfer element coupled to the spindle so as to distribute the force between both of the spindle drive threads.

9 Claims, 6 Drawing Sheets

U.S. PATENT DOCUMENTS 5,997,223 A * 12/1999 Kosmowski ..... 408/124
6,000,308 A * 12/1999 LaFountain et al. ..... 83/631
6,280,124 B1 * 8/2001 Ammann ..... 408/129
6,435,082 B1 * 8/2002 Habara ..... 83/631
7,013,776 B2 * 3/2006 Ishikawa et al. ..... 83/13
7,131,362 B1 * 11/2006 Matsuda et al. ..... 83/240
7,249,551 B1 * 7/2007 Ray ..... 83/631
7,427,258 B2 * 9/2008 Schmauder ..... 83/523
2007/0240551 A1 * 10/2007 Erlenmaier ..... 83/594
2009/0013843 A1 * 1/2009 Schmauder ..... 83/555

FOREIGN PATENT DOCUMENTS

JP 04-172133 6/1992

* cited by examiner

SPINDLE DRIVE SUPPORT

CROSS REFERENCE TO RELATED APPLICATIONS

This application is a continuation of, and claims priority under 35 U.S.C. §120 to PCT/EP2005/005635, filed on May 25, 2005, and designating the U.S., and claims priority under 35 U.S.C. §119 from European application No. 04 012 522.1, filed May 27, 2004. These priority applications are hereby incorporated by reference in their entirety.

TECHNICAL FIELD

This invention relates to industrial equipment, and more particularly to machines and methods for working with workpieces, such as metal sheets.

BACKGROUND

As those of ordinary skill in the art will appreciate, punching machines may be employed to punch holes or other cutouts from a workpiece (e.g., a metal sheet). Typically, punching machines include a tool bearing for a punching tool and a rotary/lifting drive, which moves the tool bearing back and forth along a lifting axis to a working area of the punching machine. Also, the tool bearing is rotatably adjustable about the lifting axis. The punching machine may also include a motor-driven spindle transmission provided with a drive control system. Typically, a rotary/lifting drive having two electric drive motors is provided for the tool bearing of a punching machine. Both drive motors may be arranged laterally next to a drive spindle, which in turn runs in the direction of a lifting axis of the tool bearing. One of the drive motors serves for workpiece punching and for that purpose is connected via a belt drive to a lifting spindle nut disposed on the drive spindle. By driving this spindle transmission in one direction of rotation, the tool bearing (and hence the attached punching tool) is moved with working strokes towards the workpiece to be processed and then by reversing the motor, the tool bearing is moved in the opposite direction. The second drive motor in a conventional punching machine is intended for rotary adjustment of the tool bearing and the punching tool. This drive motor is connected via another belt drive to enable rotation of the punching tool relative to the lifting axis.

Moreover, with a non-uniform force distribution to the two drive units, as would happen, for example, with force introduction at one end of a common drive spindle of two drive units, the drive units would have to accommodate different loads. A uniform construction of the drive units would then be possible only if considerable disadvantages were accepted. For instance, with a uniform construction of the drive units but significantly nonuniform load distribution there would be, for example, a markedly different wear behavior of the two drive units. The service life of the more heavily loaded drive unit would fall considerably behind the service life of the less heavily loaded drive unit. The running properties of the two drive units would also be different from each other. For instance, greater component deformation would occur on the more heavily loaded drive unit than on the less heavily loaded drive unit, the result being that in turn the uniformity of the rotary movements at both drive units would become impaired.

A more efficient punching tool would be desirable.

SUMMARY

Accordingly, one embodiment provides a lifting drive with a spindle transmission, which has two coaxial drive units with spindle transmission elements associated with one another.

The introduction of processing forces and recoil forces resulting therefrom into the spindle transmission is effected, viewed in the direction of the common spindle transmission axis, between the thread engagements of the spindle transmission elements of the two drive units close to the workpiece and remote from the workpiece. The forces to be absorbed by the spindle transmission during workpiece processing are consequently distributed uniformly to the two drive units.

In one case, the common force introduction element serves for distribution of forces effective in the direction of the spindle transmission axis and/or in the transverse direction with respect to the spindle transmission axis to the drive units of the inventive machine. In another case, in the interests of a structural simplification of the lifting drive, the common force introduction element of the two drive units of the spindle transmission is constructed in modular form (e.g., one piece) with a force transmission element, which for its part transfers to the common force introduction element the force to be introduced by the common force introduction element into the drive units.

Another configuration is distinguished by a compact method of construction. In another case, "central" force introduction is of particular advantage for machines. For example, the mutual preloading of the spindle drive elements of the drive units provided on such machines is on the one hand of great importance for the functional capability of the relevant drive units. Thus, the zero play of the thread engagement between the spindle transmission elements resulting from the mutual preloading of the spindle transmission elements allows, for example, stroke control of the drive units and a direction of rotation reversal of the spindle transmission elements rotated relative to one another without associated vibrations. At the same time, however, on account of the zero play of their spindle transmission elements such drive units respond especially sensitively to the introduction of massive loads, since there is no possibility of accommodating deformations, occurring at the spindle transmission elements, through play between these components.

For similar reasons, in other cases, the relative rotary movements of the spindle transmission elements of the two drive units are oppositely directed. With a uniform construction of the drive elements but non-uniform load distribution, non-uniform load situations would occur at the two drive units, which in turn could result in distortion of the drive units relative to one another. The uniform "central" introduction of force at lifting drives counteracts such negative phenomena To generate the oppositely directed rotary movements of the mutual spindle transmission elements, each of the drive units may have its own drive motor. If an appropriate gear mechanism is used, operation of the drive units is alternatively possible with a single drive motor.

Another configuration employs punching machines in which high processing forces often have to be applied and corresponding recoil forces have to be led off. In another example, an axial preloading arrangement effective in the direction of the spindle transmission axis is provided on punching machines for the spindle transmission elements close to the workpiece. Such preloading arrangements may increase the service life and the operational reliability of the lifting drive of punching machines.

In particular, when the punching tool strikes the workpiece, when the punching tool penetrates the workpiece and generally during reversal of the stroke movement, load alternation occurs at the lifting drive. The preloading arrangement according to the invention counteracts such a sudden load alternation at the lifting drive. With an appropriate selection of preloading, a swelling loading of the spindle transmission, causing less wear, occurs instead of an alternating loading.

In the punching operation, as the workpiece to be processed is being subjected to the action of the punching tool a force directed oppositely to the direction of the working stroke builds up inside the lifting drive. As soon as the workpiece is penetrated by the punching tool, the punching tool and the components of the lifting drive connected to it tend to perform a sudden movement in the direction of the working stroke. The sudden load alternation accompanying this would be associated at the lifting drive with an operating state that could be controlled and regulated only with comparatively great effort.

In another embodiment, there is provided a workpiece processing machine including a processing tool movable along a tool drive axis to engage a workpiece with a force, a spindle coupled to the processing tool and having two helical spindle drive threads spaced apart along the tool drive axis, through which drive threads tool forces are transmitted, and one or more drive motors operable to move the spindle and the tool along the tool drive axis, wherein the processing tool is coupled to the force transmission member to transmit force from the tool to the spindle by a force transfer element coupled to the spindle so as to distribute the force between both of the spindle drive threads.

In yet another configuration, there is provided a workpiece processing machine including a processing tool movable along a tool drive axis to engage a workpiece with a force, a force transmission member coupled to the processing tool and having two helical spindle drive threads spaced apart along the tool drive axis, through which drive threads tool forces are transmitted, and one or more drive motors operable to move the force transmission member by applying force through the spindle drive threads to displace the force transmission member and the tool along the tool drive axis, wherein the force transmission member is configured to distribute the tool force between the spindle drive threads, with each spindle drive thread bearing only a portion of the tool force.

In still another example, there is provided a machine for processing workpieces, the machine including a spindle drive having a first spindle drive unit and a second spindle drive unit, a force introduction element coupled to the first spindle drive unit and the second spindle drive unit, and a force transmission element configured to transmit a force associated with a processing tool to the force introduction element, wherein the force introduction element is configured to distribute the force between the first spindle drive unit and the second spindle drive unit.

DESCRIPTION OF DRAWINGS

The details of one or more embodiments of the invention are set forth in the accompanying drawings and the description below. Other features, objects, and advantages of the invention will be apparent from the description and drawings, and from the claims.

Like reference symbols in the various drawings indicate like elements.

DETAILED DESCRIPTION

Figure 1:
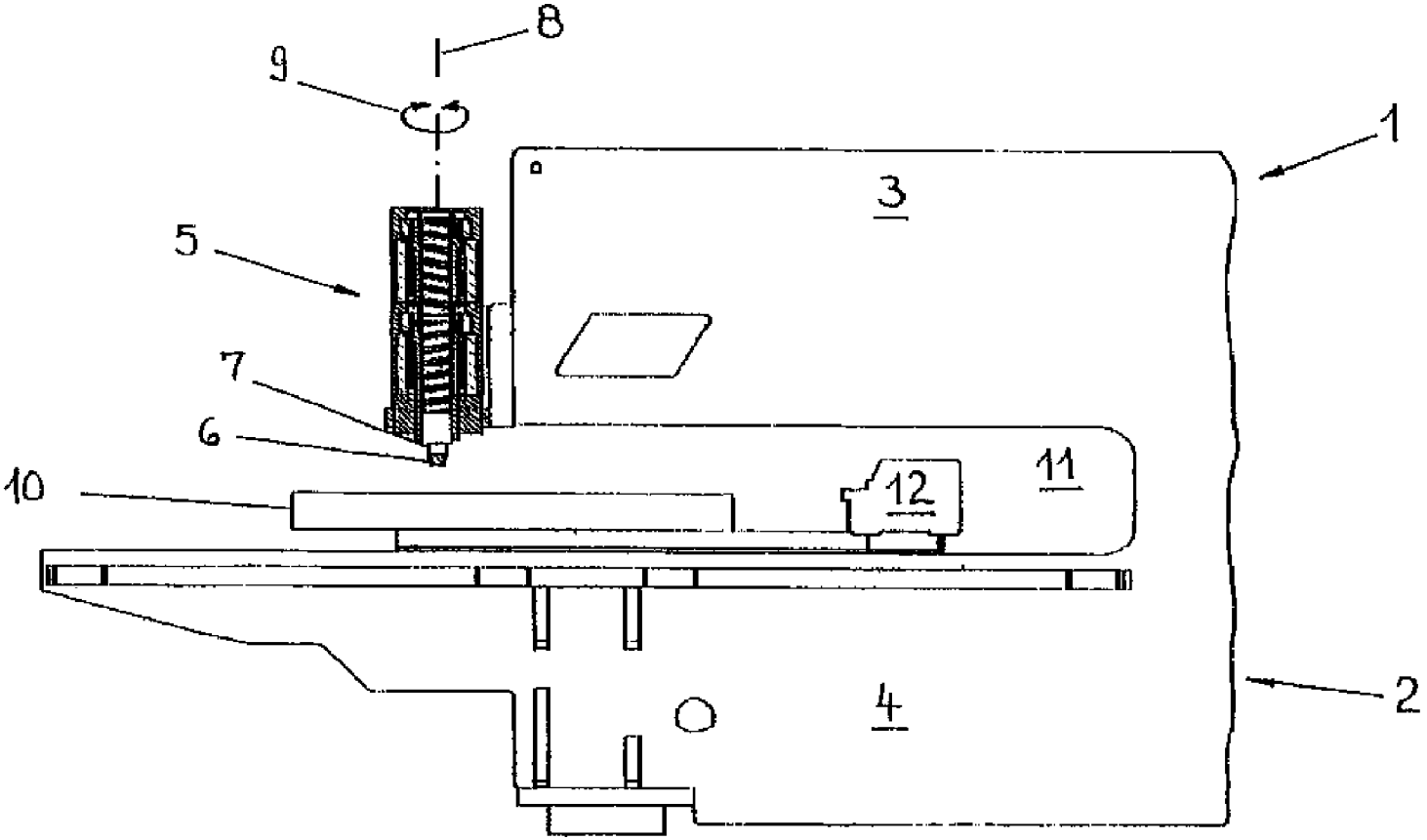
FIG. 1 shows a punching machine having a first construction of an electric lifting drive for a punch upper die in partially sectional side view.

As shown in FIG. 1, a punching machine 1 has a C-shaped machine frame 2 with an upper frame member 3 and a lower frame member 4. An electric lifting drive 5 for a processing tool in the form of a punch 6 is provided at the fire end of the upper frame member 3. The punch 6 is mounted in a tool bearing 7. By means of the lifting drive 5 the tool bearing 7 is movable in a straight line jointly with the punch 6 in the direction of a lifting axis 8. In a modified mode of operation, the lifting drive 5 can also be used as rotary drive and then serves for rotary adjustment of the punch 6 about the lifting axis 8 in the direction of a double arrow 9. Movements in the direction of the lifting axis 8 are performed by the punch 6 during working strokes for machining workpieces and during return strokes following the working strokes. Rotary adjustment is performed to change the rotated position of the punch 6 relative to the lifting axis 8.

When machining a workpiece, in the example case when punching sheets (not shown), the punch 6 co-operates with a punch lower tool (not shown) in the form of a die. This is integrated in the customary manner in a workpiece table 10, which in its turn is mounted on the lower frame member 4 of the punching machine 1. The relative movements of the relevant sheet that are required during machining of the workpiece relative to the punch 6 and the die are performed by a coordinate guide 12 housed in a gap area 11 of the machine frame 2.

Figure 2:
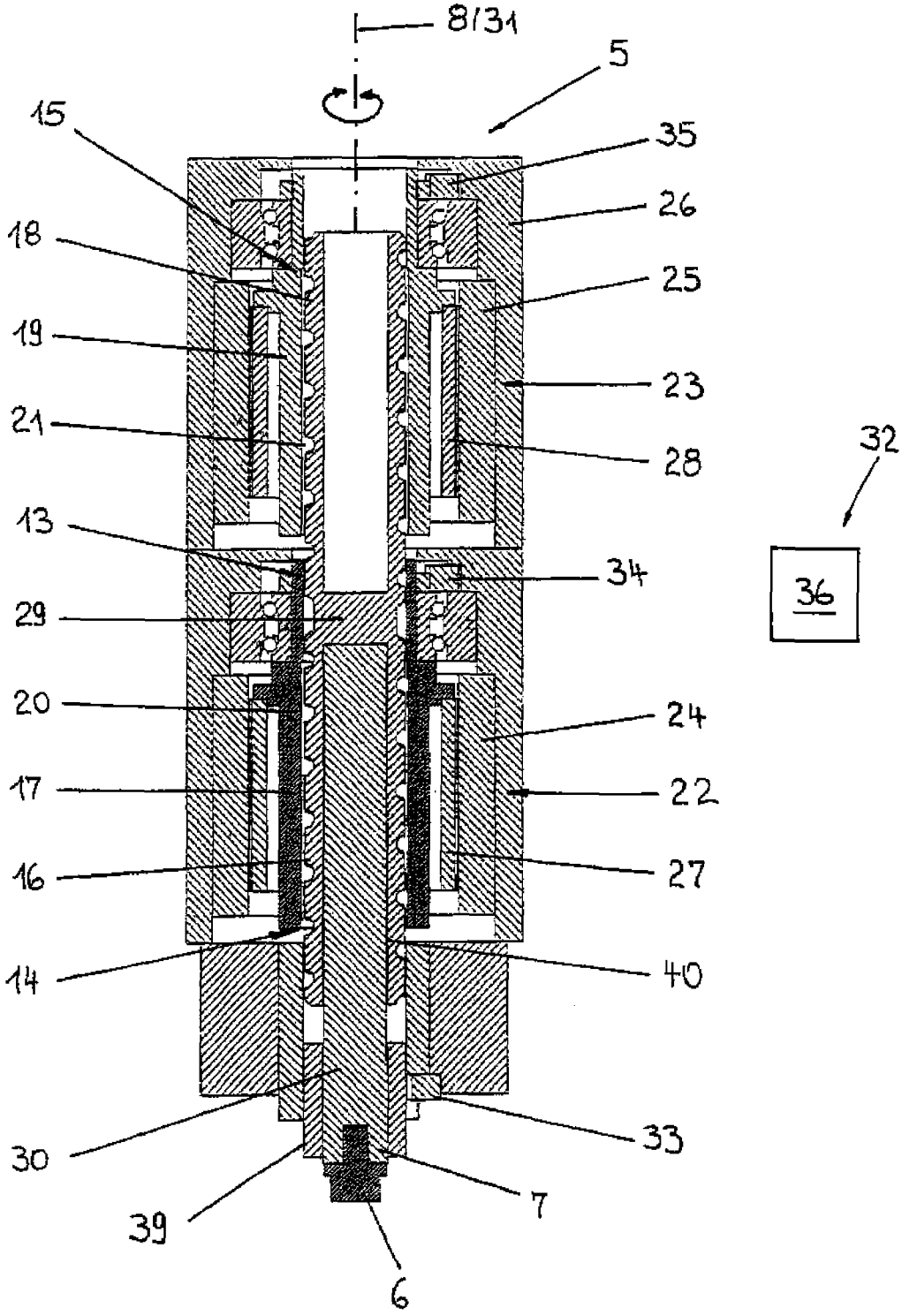
FIG. 2 shows the lifting drive in FIG. 1 in longitudinal section.

As can be inferred in detail from FIG. 2, the lifting drive 5 of the punching machine 1 includes a spindle transmission 13 with drive units 14, 15. The drive unit 14 includes a drive spindle 16 and a spindle nut 17 located thereon, and the drive unit 15 includes a drive spindle 18 and a spindle nut 19 located thereon. In one configuration, the drive spindles 16 and 18 may be helical drive spindles (as illustrated). The drive spindle 16 and the spindle nut 17 are connected with one another by way of a thread engagement 20, and drive spindle 18 and the spindle nut 19 are connected with one another by way of a thread engagement 21. The two drive units 14, 15 are designed to work in opposite directions, but are otherwise of identical construction. In one configuration, the two drive units 14, 15 are ball screw transmissions.

Electric drive motors 22, 23, in the example shown torque motors, are provided for the powered drive of the spindle transmission 13. A stator 24 of the drive motor 22 and a stator 25 of the drive motor 23 are mounted on a drive housing 26. A rotor 27 of the drive motor 22 may be gearlessly connected to the spindle nut 17 of the drive unit 14. Correspondingly, the spindle nut 19 of the drive unit 15 may be fixed to a rotor 28 of the drive motor 23. By virtue of the mutual axial overlap of the spindle nuts 17, 19 on the one hand and of the components of the drive motors 22, 23 on the other hand, a comparatively small overall installed size for the general arrangement can be achieved.

In one configuration, the drive spindles 16, 18 of the drive units 14, 15 are in the form of hollow spindles that are connected with one another by way of a common force introduction element 29 to form a one-piece modular unit. Inside, the drive spindle 16 receives a ram 30, which serves as force transmission element. At one axial end the ram 30 is provided with the tool bearing 7 and via this with the punch 6. In this region, the ram 30 is supported at the drive housing 26 in the radial direction by way of a bearing bush 39.

With its opposite axial end, the ram 30 lies against a force transfer element, such as force introduction element 29. Over the remaining axial length of the drive spindle 16, there is no connection between his and the ram 30. On the contrary, a gap 40 of annular cross-section, visible in outline in FIG. 2, remains in this region between the inner wall of the drive spindle 16 and the outer wall of the ram 30.

In one configuration, for punching workpieces, the spindle nuts 17, 19 of the drive units 14, 15 are driven by the drive motors 22, 23 with opposite directions of rotation and at corresponding speeds about the spindle transmission axis 31 coincident with the lifting axis 8. Owing to the opposite directions of rotation and the corresponding speeds of the spindle nuts 17, 19, the drive spindles 16, 18 connected to one another in one piece are not entrained by either of the spindle nuts 17, 19 in the direction of rotation. The drive spindles 16, 18 and with them the tool bearing 7 and the punch 6 do not change their rotated position relative to the lifting axis 8, (i.e., the spindle transmission axis 31). On the contrary, owing to the oppositely directed but same-speed rotary movements of the spindle nuts 17, 19, the drive spindles 16, 18 and the tool bearing 7 and the punch 6 are displaced in the direction of the lifting axis 8. In the process, the punch 6 is lowered onto the workpiece to be processed.

As the punch 6 runs onto the workpiece to be processed, and during the following punching operation, a force that acts at any rate in the direction of the lifting axis 8 and the spindle transmission axis 31 builds up at the punch 6. Over and above that, a force action in the transverse direction with respect to the spindle transmission axis 31 may also occur. Via the ram 30, both of these forces that have build up at the punch 6 in the direction of the lifting axis 8 and spindle transmission axis 31 as well as any effective transverse forces are removed into the force introduction element 29, which is arranged between the thread engagements 20, 21 of drive spindle 16 and spindle nut 17 on the one hand and drive spindle 18 and spindle nut 19 on the other hand. These forces may be hereafter referred to as the "tool force" or "tool forces." As the tool forces that have built up at the punch 6 transversely to the lifting axis 8 and the spindle transmission axis 31 are transmitted, the ram 30 may act like a two-arm lever. The "center of rotation" of this two-arm lever is defined by the bearing bush 39. On the tool side, the ram 30 has a comparatively short lever arm and towards the force introduction element 29 a comparatively long lever arm. Accordingly, even large transverse forces at the punch 6 result in comparatively small transverse forces at the force introduction element 29.

From the force introduction element 29, all forces introduced therein are distributed uniformly to the two drive units 14, 15. Each of the drive units 14, 15 and each of the thread engagements 20, 21 consequently has to accommodate approximately half of the forces that have built up at the punch 6. In the direction of the flow of force, the drive spindles 16, 18 are provided as the spindle transmission elements close to the workpiece and the spindle nuts 17, 19 as the spindle transmission elements remote from the workpiece.

Following each one of the punch strokes, the punch 6 has to perform a reverse stroke. For that purpose, the direction of rotation of the spindle nuts 17, 19 is reversed by means of a drive control 32. The spindle nuts 17, 19 now rotating opposite to their direction of rotation during the preceding punch stroke but still in opposite directions. The drive spindles 16, 18 and the punch 6 connected thereto via the ram 30 are then retracted with respect to the workpiece. For rotary adjustment of the punch 6 about the lifting axis 8, the spindle nuts 17, 19 can be operated in a corresponding direction of rotation. In the process, the spindle nuts 17, 19 entrain the drive spindles 16, 18 in the direction of rotation and with them the punch 6 without axial displacement of the punch 6.

In one set up, the rotary adjustment of the punch 6 is also controlled by the drive control 32. Sensor arrangements 33, 34, 35 and an evaluation and control unit 36 are parts of the drive control 32. The sensor arrangement 33 serves to monitor the angle of rotation and direction of rotation of the punch 6, the sensor arrangement 34 serves to monitor the angle of rotation and speed and direction of rotation of the spindle nut 17, and the sensor device 35 serves to monitor the angle of rotation and speed and direction of rotation of the spindle nut 19. On the basis of the information obtained by means of the sensor arrangements 33, 34, 35, the evaluation and control unit 36 controls the drive motors 22, 23.

In still other embodiments, the superimposition of an axial and a rotary movement of the drive spindles 16, 18 and of the punch 6 is also possible. For that purpose, the spindle nuts 17, 19 are to be driven in opposite directions of rotation and at different speeds.

Figure 3:
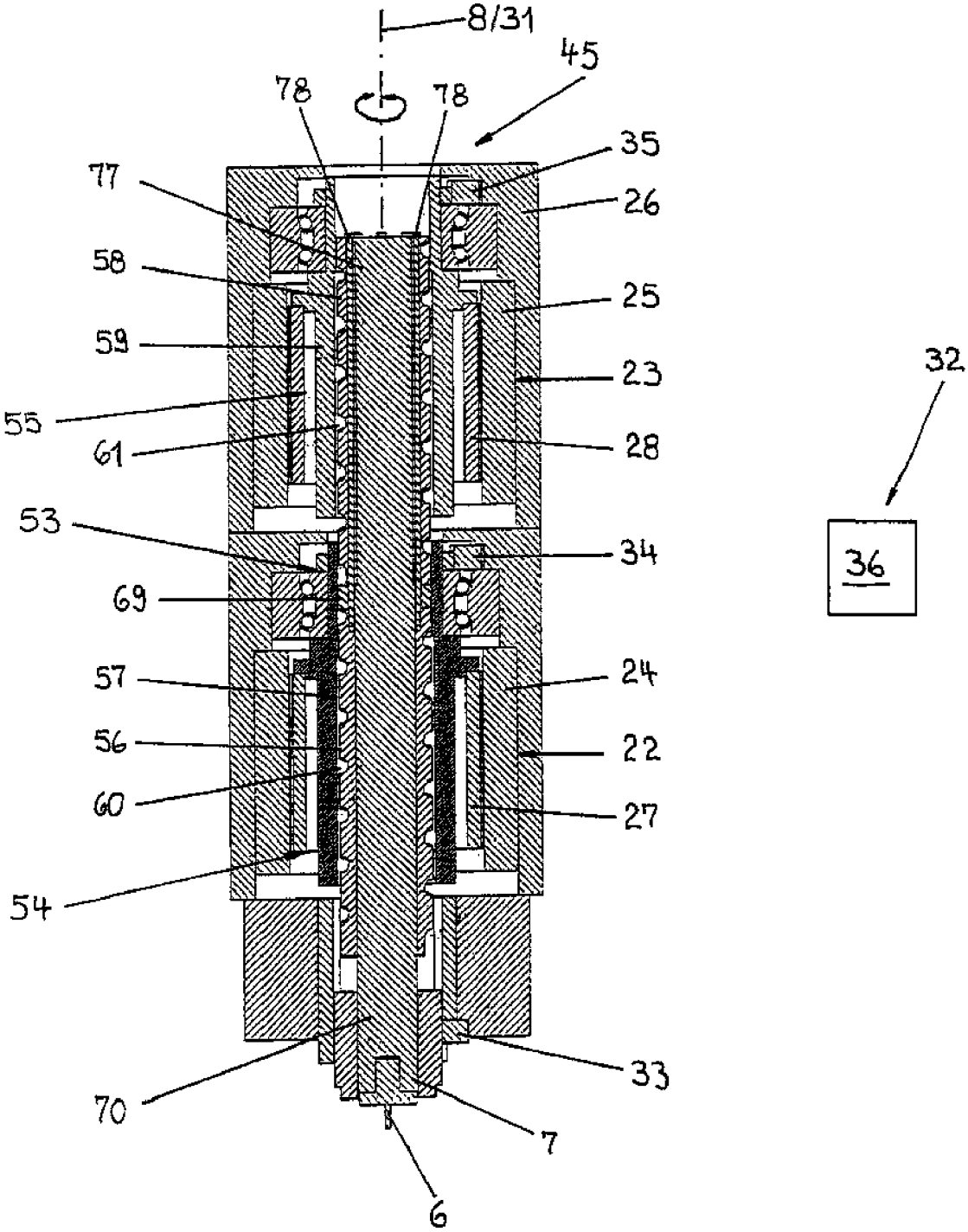
FIG. 3 shows a second construction of an electric lifting drive for a punch upper die of a punching machine in longitudinal section.

A lifting drive 45 as shown in FIG. 3 has a spindle transmission 53 with drive units 54, 55. The drive unit 54 includes a drive spindle 56 and a spindle nut 57 and the drive unit 55 includes a drive spindle 58 and a spindle nut 59. In one configuration, the drive spindles 56 and 58 may be helical drive spindles (as illustrated). The drive spindles 56, 58 are also in the form of hollow spindles. Between the drive spindle 56 and the spindle nut 57, there is a thread engagement 60, between the drive spindle 58 and the spindle nut 59 there is a thread engagement 61. A force transmission element in the form of a ram 70 is arranged inside the drive spindle 56. At its workpiece-side axial end, the ram 70 is provided with the tool bearing 7 and the punch 6. At its opposite axial end, the ram 70 is provided in one piece with a force transfer element, such as the force introduction element 69 widened radially to form an external collar. An axial extension 77 adjoins the force introduction element 69 in the direction of the spindle transmission axis 31.

The drive spindle 56 rests on the ram 70 without a connection to the ram 70 in the direction of the spindle transmission axis 31. Correspondingly, the drive spindle 58 is arranged on the axial extension 77 of the ram 70. The drive spindles 56, 58 are connected effectively in the axial direction exclusively with the force introduction element 69. Fixing screws 78 that fix the drive spindles 56, 58 all-round to the force introduction element 69 are used for that purpose. In the transverse direction with respect to the spindle transmission axis 31, the drive spindles 56, 58 rest with zero play against the ram 70 and the axial extension 77 respectively.

In one configuration, the drive spindles 56, 58 constitute tool-side spindle transmission elements of the drive units 54, 55, and the spindle nuts 57, 59 constitute spindle transmission elements of the drive units 54, 55 remote from the workpiece. Apart from the described variations, the lifting drive 45 according to FIG. 3 is of identical construction with the lifting drive 5 shown in FIG. 2. The same reference numerals are used in FIGS. 2 and 3 for corresponding components. However, unlike the situation according to FIG. 2, the force introduction element 69 of the lifting drive 45 according to FIG. 3 effects only a uniform distribution of forces that have built up at the punch 6 in the direction of the lifting axis 8 and spindle transmission axis 31 to the drive units 54, 55. By virtue of the zero-play transverse support of the ram 70 and the axial extension 77, transverse forces effective at the punch 6 are removed via the ram 70 into the drive spindle 56 and via the axial extension 77 into the drive spindle 58.

Figure 4:
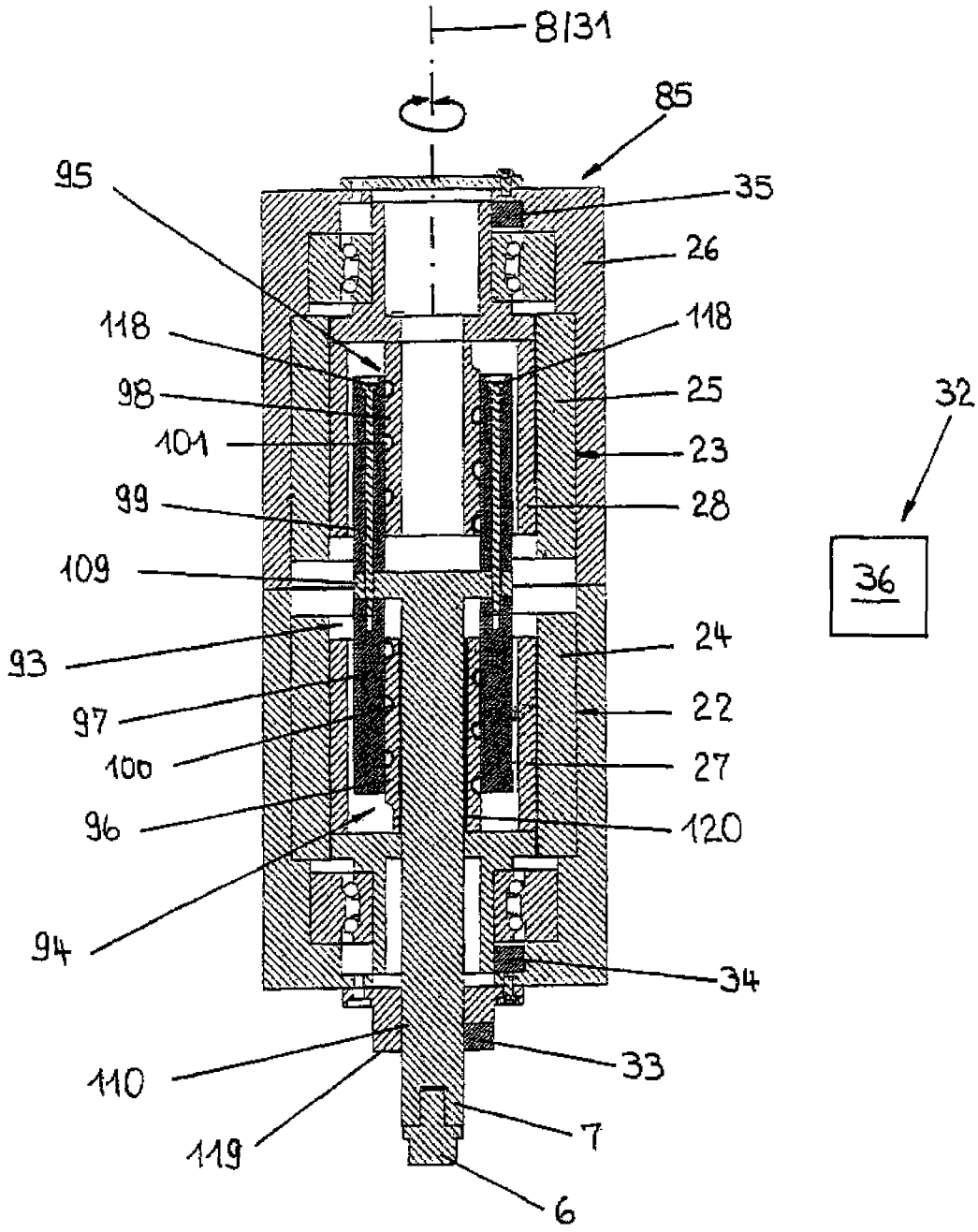
FIG. 4 shows a third construction of an electric lifting drive for a punch upper die of a punching machine in longitudinal section.

FIG. 4 shows another configuration of a lifting drive 85, where drive spindles 96, 98 of drive units 94, 95 of a spindle transmission 93 are connected gearlessly to rotors 27, 28 of drive motors 22, 23. In one configuration, the drive spindles 96 and 98 may be helical drive spindles (as illustrated). The drive spindles 96, 98 form spindle transmission elements of the drive units 94, 95 remote from the workpiece. Spindle nuts 97, 99 are provided as spindle transmission elements of the drive units 94, 95 close to the workpiece. These spindle nuts are mounted on a force transfer element, such as force introduction element 109 by fixing screws 118 and are therefore connected to the force introduction element 109 so as to transmit force. The force introduction element 109 is constructed in one piece with a ram 110 provided as force transmission element. The drive spindle 96 rests loosely on the ram 110, i.e. without creating a force-fit connection or interlocking connection in the direction of the lifting axis 8 and spindle axis 31 and with clearance, indicated in FIG. 4, in the transverse direction of the lifting axis 8 and the spindle transmission axis 31. A gap between the ram 110 and the drive spindle 96 is assigned the reference numeral 120.

The tool bearing 7 with the punch 6 is provided at the workpiece-side axial end of the ram 110. Thread engagements between the drive spindles 96, 98 and the respective associated spindle nuts 97, 99 have been assigned the reference numerals 100, 101. Otherwise, the same reference numerals as in the preceding Figures are also used in FIG. 4. Tool forces in the axial direction and in the transverse direction that have built up at the punch 6 are distributed via the force introduction element 109 to the drive units 94, 95. As the transverse forces are removed, a bearing bush 119 acts as "center of rotation" for the ram 110 forming a two-arm lever.

In another embodiment, there is provided a lifting drive 125 that includes a spindle transmission 133 with drive units 134, 135. The lifting drive 125 shown in FIG. 5 corresponds in its construction largely to the lifting drive 5 according to FIG. 2. Drive spindles 136, 138 in the form of hollow spindles support spindle nuts 137, 139 via thread engagements 140, 141. In one configuration, the drive spindles 136 and 138 may be helical drive spindles (as illustrated). The drive spindles 136, 138 form spindle transmission elements of the drive units 134, 135 close to the workpiece and the spindle nuts 137, 139 form spindle transmission elements remote from the workpiece. The same reference numerals as in the preceding diagrams have also, as far as possible, been used in FIG. 5.

Figure 5:
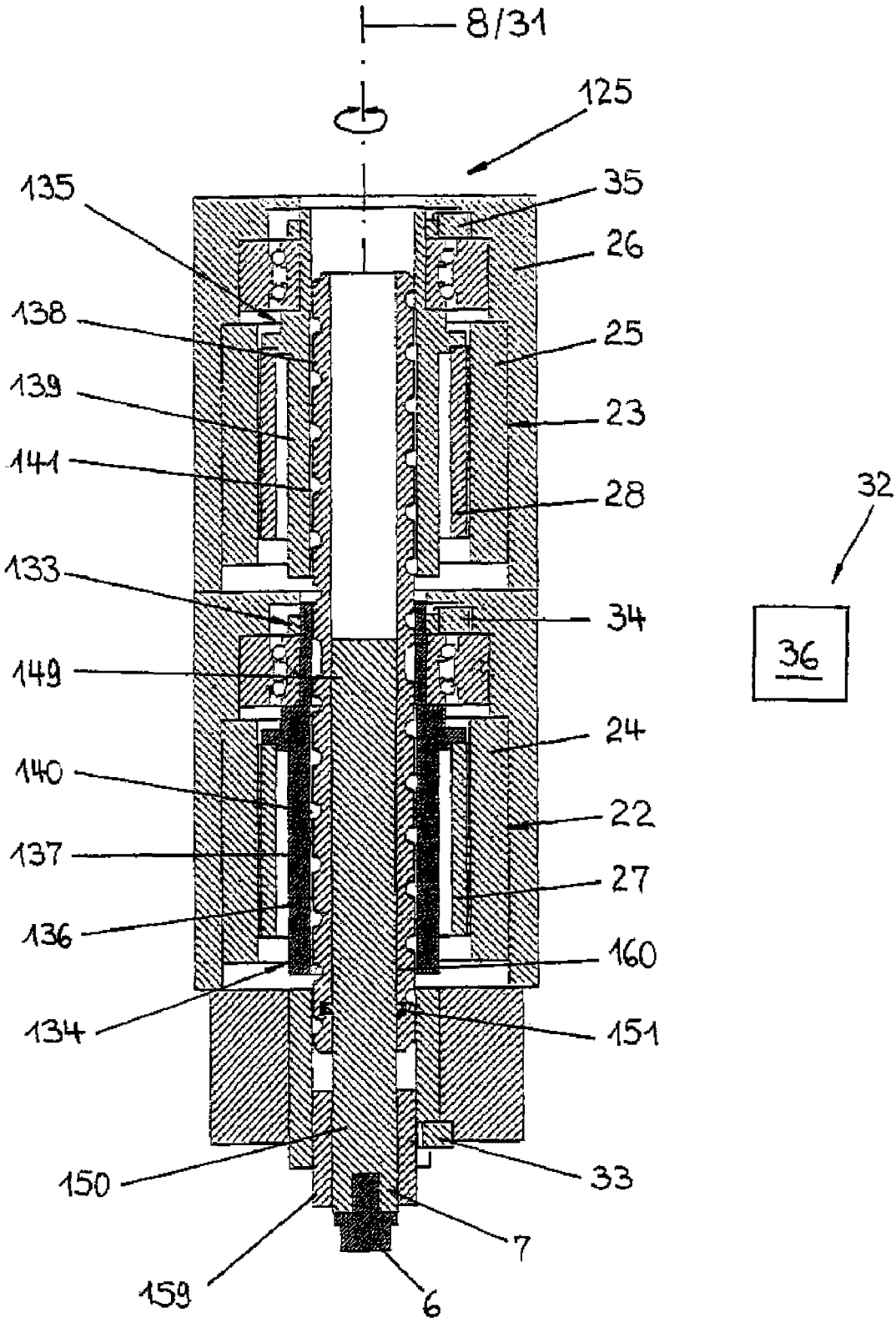
FIG. 5 shows a fourth construction of an electric lifting drive for a punch upper die of a punching machine in longitudinal section.

However, unlike the conditions according to FIG. 2, in the case of the lifting drive 125 according to FIG. 5 a force transmission element in the form of a ram 150 is supported in the direction of the lifting axis 8 and spindle transmission axis 31 exclusively at the drive spindle 137. Support of the ram 150 is affected by an external collar 151 mounted thereon, which engages radially in the drive spindle 136. Otherwise, between the outer wall of the ram 150 and the inner wall of the drive spindle 136 there is a gap 160, indicated in outline in FIG. 5.

At its end remote from the punch 6 the ram 150 changes into a force transfer element, such as force introduction element 149, which is widened radially relative to the ram 150 and lies with zero play against the inner wall of the transition region between the drive spindles 136, 138 transversely to the stroke direction 8 and the spindle transmission axis 31. There is no connection effective in the axial direction between the force introduction element 149 and the drive spindles 136, 138.

By virtue of the described support of ram 150 and force introduction element 149, the force introduction element 149 affects a uniform distribution to the drive units 134, 135 of tool forces that have built up at the punch 6 transversely to the lifting axis 8, but not of forces acting at the punch 6 in the direction of the lifting axis 8. During removal of the transverse forces, a bearing bush 159 of the ram 150 acts as "center of rotation".

Figure 6:
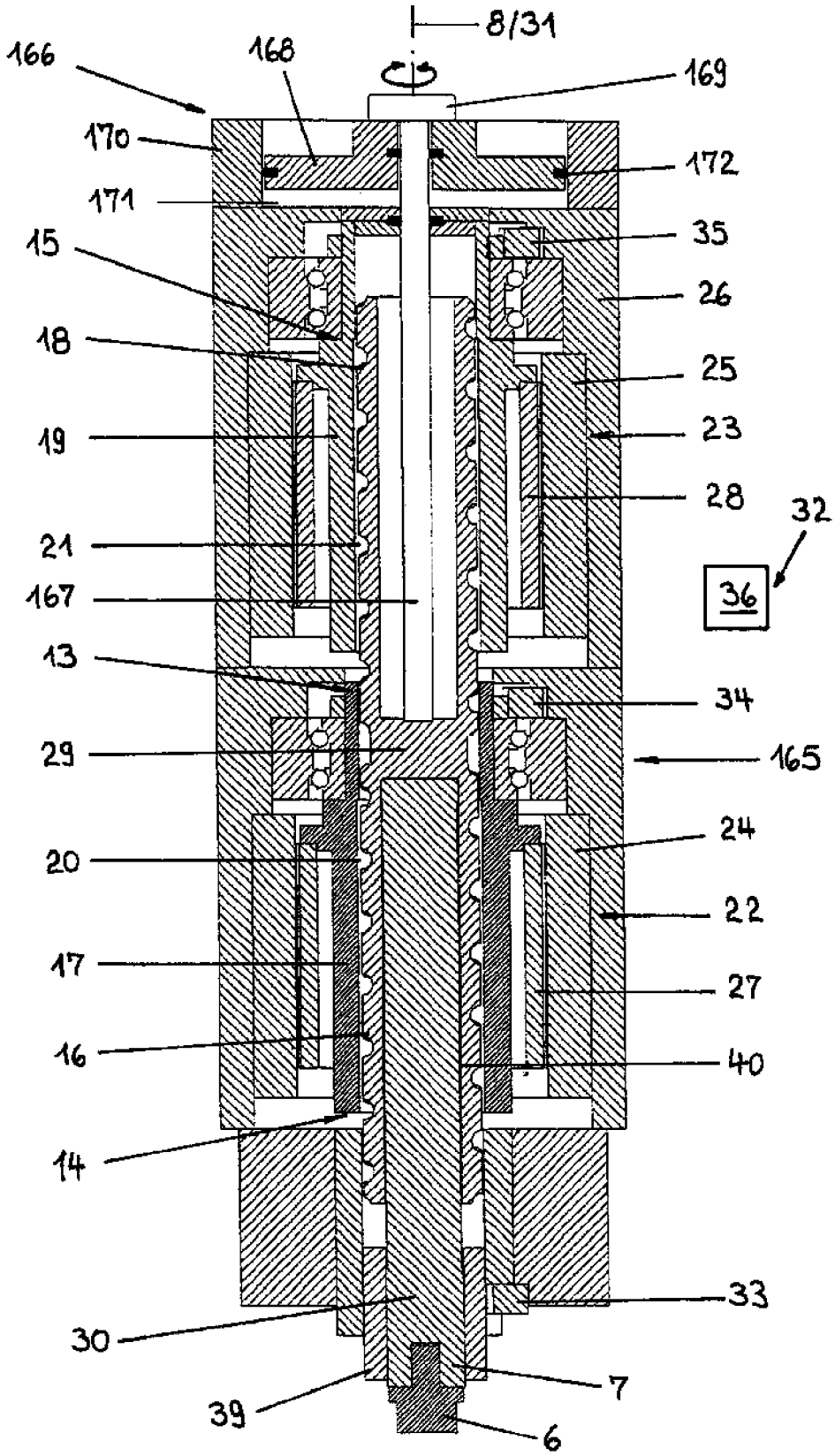
FIG. 6 shows a fifth construction of an electric lifting drive for a punch upper die of a punching machine in longitudinal section.

In a next construction, a lifting drive 165, as shown in FIG. 6, corresponds in its construction largely to the lifting drive 5 according to FIG. 2. In addition to the components of the lifting drive 5, the lifting drive 165 is equipped with an axial preloading arrangement 166. The axial preloading arrangement 166 includes a plunger 167, which at one end is connected at the common force introduction element 29 to the structural unit formed by the drive spindles 16, 18. With its opposite axial end the plunger 167 passes through a piston 168. The plunger 167 rests with a radial projection 169 on the piston 168.

The piston 168 is movably guided in the direction of the spindle transmission axis 31 in a cylindrical ring 170 provided on the drive housing 26. The plunger 167 is rotatable about its longitudinal axis relative to the piston 168. A pressure space 171 formed between the piston 168 and the drive housing 26 and the cylindrical ring 170 respectively is filled with air and is sealed with respect to its surroundings by sealing elements 172.

During punching of workpieces, the structural unit including drive spindle 16 and drive spindle 18 moves downwards in the direction of the lifting axis 8 and spindle transmission axis 31. The plunger 167 connected to the drive spindles 16, 18 performs a movement in the same direction and entrains the piston 168 with it. The air in the pressure space 171 is consequently compressed. Via the piston 168 and the plunger 167, the compressed air in the pressure space 171 exerts a force directed upwardly in the direction of the lifting axis 8 and the spindle transmission axis 31 on the drive spindles 16, 18 and via these on the tool bearing 7 and the punch 6.

When the workpiece to be processed is subjected to the action of the punch 6, a force likewise directed upwardly in the direction of the lifting axis 8 and the spindle transmission axis 31 builds up in the components of the lifting drive 165 connected to the punch 6. When the punch 6 penetrates the workpiece, then the punch 6 and the components of the lifting drive 165 connected to it attempt to perform a sudden movement directed downwardly in the direction of the lifting axis 8 and the spindle transmission axis 31. Such a sudden movement is prevented by the preload force exerted by the axial preloading arrangement 166, specifically by the pressure space 171. The command of control and regulation of the operating state of the lifting drive 165, that operating state being characterized by an extreme load alternation when the workpiece being processed is penetrated by the punch 6, is thereby simplified. In another configuration, instead of the sealed pressure space 171, a different pressure space is possible, which is connected to a pressure control arrangement. Furthermore, an alternative to air used in the example case shown, other pressure media, preferably of a gaseous nature, are possible.

Additional description of one or more of the features described above may be provided in commonly assigned U.S. patent application Ser. No. 11/563,528, entitled PUNCH TOOL LIFT SPINDLE, filed Nov. 27, 2006 (Our Ref.: 15540-099001), and/or commonly assigned U.S. Pat. No. 7,427,258, entitled COUNTER-ROTATING SPINDLE TRANSMISSION, filed Nov. 27, 2006 (Our Ref.: 15540-101001). Both of these applications are hereby incorporated by reference.

A number of embodiments of the invention have been described. Nevertheless, it will be understood that various modifications may be made without departing from the spirit and scope of the invention. For example, in some other embodiments, other suitable motors or transmissions may be employed. Accordingly, other embodiments are within the scope of the following claims.

What is claimed is:

1. A machine for processing workpieces, the machine comprising:

a spindle drive having a first spindle drive unit and a second spindle drive unit, each spindle drive unit having a drive spindle and a spindle nut connected with one another by way of a thread engagement;

a processing tool movable by means of the spindle drive to engage a workpiece;

a force introduction element coupled to the first spindle drive unit and the second spindle drive unit, the force introduction element connecting the spindles of the spindle drive units to each other to form a one-piece modular unit; and a force transmission element configured to transmit a force associated with the processing tool to the force introduction element, wherein the force transmission element is provided at one axial end with a bearing for the processing tool and lies with its opposite axial end against the force introduction element thus transmitting the force associated with the processing tool into the force introduction element, the force introduction element being configured to distribute the force associated with the processing tool to the first spindle drive unit and the second spindle drive unit.

2. The machine of claim 1, wherein the force associated with the processing tool and transmitted by the force transmission element acts in the direction of a common spindle transmission axis of the spindle drive units.

3. The machine of claim 1, wherein the force associated with the processing tool and transmitted by the force transmission element acts in the transverse direction of a common spindle transmission axis of the spindle drive units.

4. The machine of claim 1, wherein the machine is a punching machine.

5. The machine of claim 1, wherein the force transmission element is a ram.

6. The machine of claim 1, wherein the drive spindles of the first and second spindle drive units are hollow.

7. The machine of claim 6, wherein one of the hollow spindles receives the force transmission element that is in the form of a ram.

8. The machine of claim 1, comprising electric drive motors, one for each of the first spindle drive unit and the second spindle drive unit.

9. The machine of claim 8, wherein the electric drive motors each have a rotor that is gearlessly connected to the spindle nut of the associated spindle drive unit.

* * * * *